US010655195B2

(12) United States Patent
Nakamura et al.

(10) Patent No.: US 10,655,195 B2
(45) Date of Patent: May 19, 2020

(54) MARTENSITIC STAINLESS STEEL

(71) Applicant: JFE STEEL CORPORATION, Chiyoda-ku, Tokyo (JP)

(72) Inventors: Tetsuyuki Nakamura, Tokyo (JP); Takashi Samukawa, Tokyo (JP); Mitsuyuki Fujisawa, Tokyo (JP); Chikara Kami, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 114 days.

(21) Appl. No.: 15/565,998

(22) PCT Filed: Apr. 15, 2016

(86) PCT No.: PCT/JP2016/002044
§ 371 (c)(1),
(2) Date: Oct. 12, 2017

(87) PCT Pub. No.: WO2016/170761
PCT Pub. Date: Oct. 27, 2016

(65) Prior Publication Data

US 2018/0112285 A1 Apr. 26, 2018

(30) Foreign Application Priority Data

Apr. 21, 2015 (JP) ..... 2015-086981

(51) Int. Cl.
*C22C 38/00* (2006.01)
*C22C 38/02* (2006.01)
(Continued)

(52) U.S. Cl.
CPC ..... *C21D 9/46* (2013.01); *C21D 1/18* (2013.01); *C21D 1/25* (2013.01); *C21D 6/002* (2013.01);
(Continued)

(58) Field of Classification Search
CPC ..... C22C 38/48; C22C 38/46; C22C 38/001; C22C 38/26; C22C 38/24
See application file for complete search history.

(56) References Cited

U.S. PATENT DOCUMENTS 3,556,776 A * 1/1971 Clarke, Jr. et al. ..... C22C 38/12 420/52
4,812,176 A * 3/1989 Tanaka ..... C21D 6/002 148/597
(Continued)

FOREIGN PATENT DOCUMENTS

CN 101906587 A 12/2010
EP 1314791 A1 5/2003
(Continued)

OTHER PUBLICATIONS

Bramfitt, Bruce. "Structure/Property Relationships in Irons and Steels" (1998), ASM International, Metals Handbook Desk Edition, 2nd ed., p. 153-173. (Year: 1998).*
(Continued)

*Primary Examiner* — Melvin C. Mayes
*Assistant Examiner* — Christopher Douglas Moody
(74) *Attorney, Agent, or Firm* — Kenja IP Law PC

(57) ABSTRACT

The disclosure is to provide a martensitic stainless steel excellent in strength, workability and corrosion resistance. The martensitic stainless steel comprises a chemical composition containing, in mass %: C: 0.020% or more and less than 0.10%, Si: 0.01% or more and 2.0% or less, Mn: 0.01% or more and 3.0% or less, P: 0.050% or less, S: 0.050% or less, Cr: 10.0% or more and 16.0% or less, Ni: 0.01% or more and 0.80% or less, Al: 0.001% or more and 0.50% or less, and N: more than 0.050% and 0.20% or less, satisfying N % C %, and the balance containing Fe and incidental
(Continued)

impurities, where C % and N % indicate respectively the contents of C and N (mass %) in the steel.

2 Claims, 1 Drawing Sheet

(51) Int. Cl.

| | |
|---|---|
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/40*** | (2006.01) |
| ***C22C 38/04*** | (2006.01) |
| ***C22C 38/58*** | (2006.01) |
| ***C21D 9/46*** | (2006.01) |
| ***C21D 6/00*** | (2006.01) |
| ***C21D 1/18*** | (2006.01) |
| ***C22C 38/42*** | (2006.01) |
| ***C21D 1/25*** | (2006.01) |
| ***C21D 8/04*** | (2006.01) |
| ***C21D 9/00*** | (2006.01) |

(52) U.S. Cl.

CPC ..... *C21D 6/004* (2013.01); *C21D 6/005* (2013.01); *C21D 6/007* (2013.01); *C21D 6/008* (2013.01); *C21D 8/0426* (2013.01); *C21D 8/0436* (2013.01); *C21D 9/0068* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C21D 2211/001* (2013.01); *C21D 2211/005* (2013.01); *C21D 2211/008* (2013.01)

(56) References Cited

U.S. PATENT DOCUMENTS

| | | | | |
|---|---|---|---|---|
| 4,824,491 | A * | 4/1989 | Tanaka | C21D 8/0205 148/597 |
| 4,938,808 | A * | 7/1990 | Miura | C21D 8/0205 148/325 |
| 5,049,210 | A | 9/1991 | Miyasaka et al. | |
| 5,178,693 | A | 1/1993 | Miyakusu et al. | |
| 5,624,504 | A * | 4/1997 | Miyakusu | C22C 38/40 148/325 |
| 6,277,215 | B1 * | 8/2001 | Adachi | C22C 38/001 148/325 |
| 6,386,342 | B1 * | 5/2002 | Tsuge | C21D 6/002 148/325 |
| 6,884,388 | B2 | 4/2005 | Ozaki et al. | |
| 8,557,059 | B2 | 10/2013 | Welch et al. | |
| 8,852,361 | B2 * | 10/2014 | Hirasawa | F16D 65/125 148/325 |
| 2004/0096352 | A1 | 5/2004 | Ozaki et al. | |
| 2004/0168750 | A1 * | 9/2004 | Tomimura | C21D 6/004 148/325 |
| 2005/0274436 | A1 * | 12/2005 | Kondo | C22C 38/46 148/326 |
| 2008/0069719 | A1 * | 3/2008 | Beguinot | B29C 33/38 420/61 |
| 2009/0098008 | A1 | 4/2009 | Amaya et al. | |
| 2009/0104068 | A1 * | 4/2009 | Hirasawa | C21D 1/18 420/38 |
| 2012/0125724 | A1 * | 5/2012 | Yamauchi | C21D 6/002 188/218 XL |
| 2014/0299239 | A1 * | 10/2014 | Adachi | C21D 6/002 148/609 |
| 2016/0281189 | A1 | 9/2016 | Fujisawa et al. | |
| 2019/0119775 | A1 * | 4/2019 | Nakamura | C21D 9/46 |

FOREIGN PATENT DOCUMENTS

| | | | |
|---|---|---|---|
| EP | 1840237 | A1 | 10/2007 |
| JP | S59211552 | A | 11/1984 |
| JP | S61174361 | A | 8/1986 |
| JP | S6328829 | A | 2/1988 |
| JP | H02217444 | A | 8/1990 |
| JP | H02247360 | A | 10/1990 |
| JP | H0356621 | A | 3/1991 |
| JP | H0375335 | A | 3/1991 |
| JP | H07278758 | A | 10/1995 |
| JP | H07316740 | A | 12/1995 |
| JP | H08109444 | A | 4/1996 |
| JP | H08319519 | A | 12/1996 |
| JP | H10245656 | A | 9/1998 |
| JP | 2001107195 | A | 4/2001 |
| JP | 2001140041 | A | 5/2001 |
| JP | 2002038243 | A | 2/2002 |
| JP | 2002097554 | A | 4/2002 |
| JP | 2002146488 | A | 5/2002 |
| JP | 2002146489 | A | 5/2002 |
| JP | 2004099990 | A | 4/2004 |
| JP | 2005054272 | A | 3/2005 |
| JP | 2006097050 | A | 4/2006 |
| JP | 2010106315 | A | 5/2010 |
| JP | 2012528943 | A | 11/2012 |
| WO | 2006061881 | A1 | 6/2006 |
| WO | 2014148015 | A1 | 9/2014 |

OTHER PUBLICATIONS

JPlatPat Machine Translation of JPH10245656 (Year: 2019).*

ASM International. "Introduction to Tensile Testing" (2004), Tensile Testing, 2nd ed., p. 1-12 (Year: 2004).*

Espacenet machine translation of JPH08319519 (Year: 2019).*

Dec. 15, 2017, Extended European Search Report issued by the European Patent Office in the corresponding European Patent Application No. 16782785.6.

Sep. 4, 2018, Office Action issued by the State Intellectual Property Office in the corresponding Chinese Patent Application No. 201680023113.0 with English language Search Report.

Dec. 17, 2018, Office Action issued by the Korean Intellectual Property Office in the corresponding Korean Patent Application No. 10-2017-7030553 with English language concise statement of relevance.

Jan. 29, 2019, Office Action issued by the State Intellectual Property Office in the corresponding Chinese Patent Application No. 201680023113.0 with English language concise statement of relevance.

Feb. 18, 2019, Communication pursuant to Article 94(3) EPC issued by the European Patent Office in the corresponding European Patent Application No. 16782785.6.

Jul. 19, 2016, International Search Report issued in the International Patent Application No. PCT/JP2016/002044.

Jul. 2, 2019, Office Action issued by the China National Intellectual Property Administration in the corresponding Chinese Patent Application No. 201680023113.0 with English language Concise Statement of Relevance.

* cited by examiner

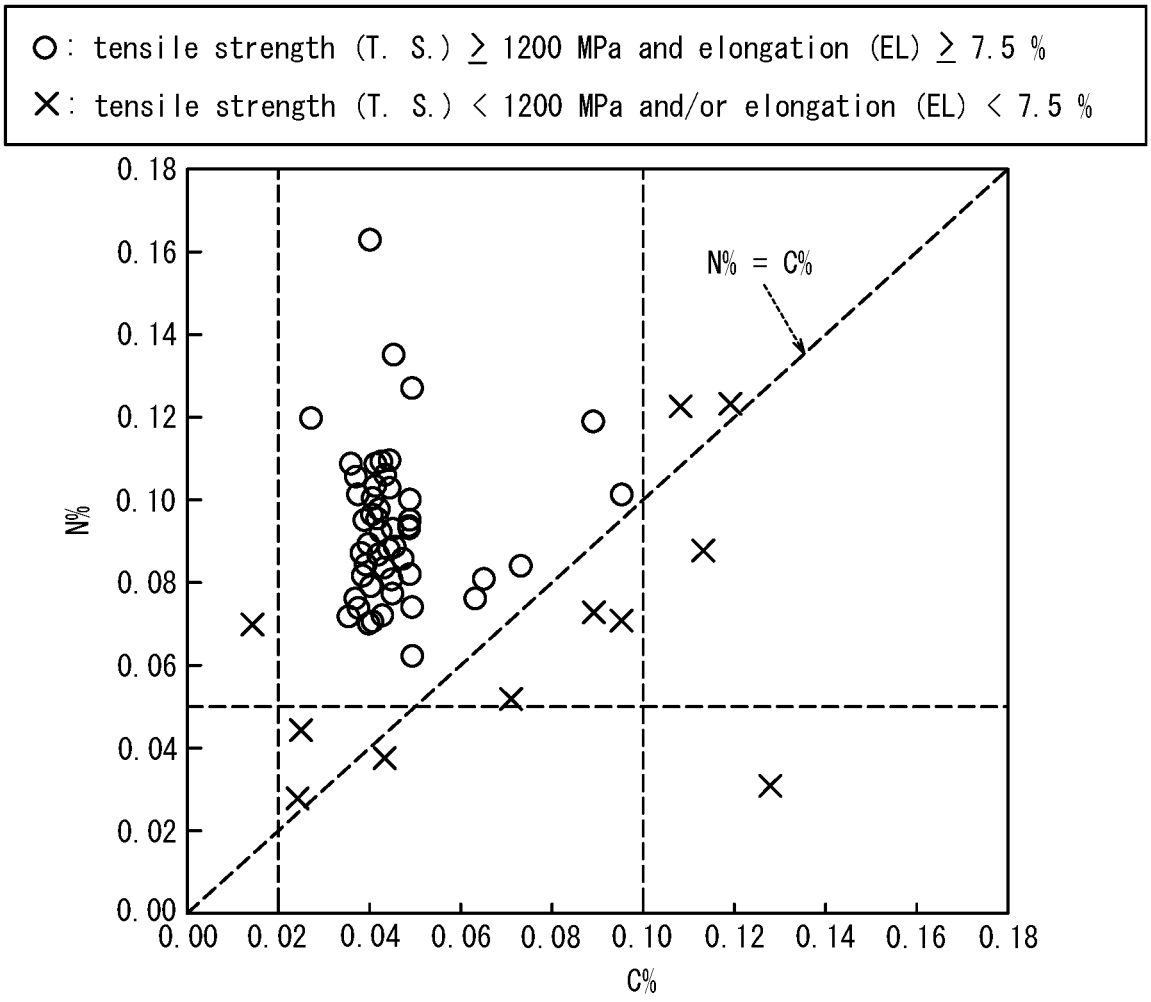
○: tensile strength (T. S.) ≥ 1200 MPa and elongation (EL) ≥ 7.5 %
×: tensile strength (T. S.) < 1200 MPa and/or elongation (EL) < 7.5 %
N% = C%
N%
C%
0.00
0.02
0.04
0.06
0.08
0.10
0.12
0.14
0.16
0.18

MARTENSITIC STAINLESS STEEL

TECHNICAL FIELD

The present disclosure relates to a martensitic stainless steel excellent in strength, elongation and corrosion resistance.

BACKGROUND

Gaps between two parts of the exhaust system of an automobile are sealed by seal parts called gasket in order to prevent leakage of exhaust gas, coolant, lubricating oil and the like. The gap between the parts widens or narrows according to the pressure variation in pipes and the like, and the gasket need to exhibit seal performance in either case, so a convex portion called bead is shaped on the gasket. The bead is being compressed and relaxed when being used and the process repeats, so a high tensile strength is required. Furthermore, the bead may be subjected to a severe processing according to its shape, so an excellent workability is also required for materials used in gasket. Moreover, the gasket is exposed to exhaust gas, coolant and the like when being used, so a corrosion resistance is also needed. A breaking up caused by corrosion may occur if the material used in gasket has a poor corrosion resistance.

Conventionally, austenitic stainless steels that have both a high strength and a high workability, such as SUS301 (17 mass % of Cr-7 mass % of Ni) and SUS304 (18 mass % of Cr-8 mass % of Ni), were usually used as gasket materials. However, since austenitic stainless steels contain a high content of Ni, which is an expensive element, there is a serious problem in term of material cost. Furthermore, austenitic stainless steels also have a problem of high susceptibility to stress corrosion cracking.

Responding to these problems, there are proposals of martensitic stainless steels such as SUS403 (12 mass % of Cr-0.13 mass % of C), and stainless steels that comprise a multi-phase structure containing martensite. Both are inexpensive stainless steels because of a low content of Ni, and the strength thereof can be improved by quenching heat treatment.

For example, JP 2002-38243 A (PTL 1) discloses a martensitic stainless steel and a dual phase stainless steel with martensite and ferrite phases, whose fatigue properties are improved by performing quenching heat treatment in a nitrogen-containing atmosphere, nitriding the surface layer and forming an austenite phase.

JP 2005-54272 A (PTL 2) discloses a dual phase stainless steel with martensite and ferrite phases whose hardness and workability are both kept by performing quenching in a two-phase temperature range of austenite and ferrite.

JP 2002-97554 A (PTL 3) discloses a multi-phase structure stainless steel, where the surface layer consists of martensite and retained austenite phases, and the inner layer consists of martensite single phase by performing quenching heat treatment in a nitrogen-containing atmosphere.

Furthermore, JP H03-56621 A (PTL 4) discloses a dual phase stainless steel with martensite and ferrite phases whose spring properties are improved by performing aging treatment after multi-phase heat treatment.

JP H08-319519 A (PTL 5) discloses a dual phase stainless steel with martensite and ferrite phases having a desired hardness by providing the cold rolling ratio.

JP 2001-140041 A (PTL 6) discloses a stainless steel where the surface layer is with two phases of martensite and retained austenite.

JP 2006-97050 A (PTL 7) discloses a stainless steel where SUS403 and the like absorb Nitrogen and precipitate nitrogen compounds on the surface layer.

JP H07-316740 A (PTL 8) discloses a multi-phase structure stainless steel where the surface layer with a depth of at least 1 μm from the outermost surface is covered with a martensite single-phase layer.

CITATION LIST

Patent Literature

PTL 1: JP 2002-38243 A
PTL 2: JP 2005-54272 A
PTL 3: JP 2002-97554 A
PTL 4: JP H03-56621 A
PTL 5: JP H08-319519 A
PTL 6: JP 2001-140041 A
PTL 7: JP 2006-97050 A
PTL 8: JP H07-316740 A

SUMMARY

Technical Problem

However, all of the stainless steels of PTLS 1 to 3 increase C content to increase the strength, and therefore have problems in workability.

In PTL 4, the stainless steel can obtain a desired hardness when the C content or Ni content is high. However, a high content of C makes the workability insufficient, and a high content of Ni requires high costs.

In PTL 5, the workability of the stainless steel decreases due to cold rolling, and in PTLS 6 and 7, the workability of the stainless steels is also insufficient. Therefore, it is hard to say that a compatibility of strength and workability has been sufficiently achieved for these stainless steels in PTLS 5 to 7.

Moreover, regarding the stainless steel in PTL 8, there are problems that the workability is poor due to a high content of C, or a sufficient strength cannot be secured due to low contents of both C and N, or a sufficient strength cannot be secured due to a high content of Cr.

As described above, martensite stainless steels have a small susceptibility to stress corrosion cracking and an inexpensive price compared with austenitic stainless steel, yet the workability thereof is poor. Regarding quenched martensitic stainless steels, the workability can be improved by performing heat treatment at a relatively low temperature called tempering, yet such treatment leads to a decrease in strength and corrosion resistance due to precipitation of Cr carbide.

Aiming at solving the aforementioned problems, it could be helpful to provide a martensitic stainless steel having a compatibility between excellent strength and workability, and further possessing an excellent corrosion resistance.

Solution to Problem

We studied on strength, workability and corrosion resistance of martensitic stainless steels, particularly the influence of C content and N content on the strength, workability and corrosion resistance, and discovered the following.

(1) Although C effectively increases the strength after quenching, it significantly reduces the workability, particularly elongation. On the other hand, although N is slightly inferior to C in the effect of increasing the strength, its disadvantage of decreasing elongation is smaller than that of C. Therefore, it is effective to use N to improve the strength and elongation in good balance.

(2) By optimizing Cr content and Ni content, and then increasing N and suppressing C until the N content is equal to or more than the C content, a martensitic stainless steel having an excellent strength-elongation balance, where a sufficient strength is secured and an excellent elongation is also achieved, can be obtained.

(3) When C content increases, the corrosion resistance is tend to decrease due to precipitation of coarse Cr carbide. On the other hand, when N content increases, Cr nitride precipitates, yet the nitride coarsens harder than carbide. Therefore, by controlling the C content and N content in a way described in (2), it is possible to minimize the decrease of corrosion resistance after quenching and after tempering.

The disclosure is based on the aforementioned discoveries and further studies.

In detail, we provide:

1. A martensitic stainless steel comprising a chemical composition containing (consisting of), in mass %:

C: 0.020% or more and less than 0.10%,
Si: 0.01% or more and 2.0% or less,
Mn: 0.01% or more and 3.0% or less,
P: 0.050% or less,
S: 0.050% or less,
Cr: 10.0% or more and 16.0% or less,
Ni: 0.01% or more and 0.80% or less,
Al: 0.001% or more and 0.50% or less, and
N: more than 0.050% and 0.20% or less, satisfying a following relational expression (1), and the balance containing Fe and incidental impurities, $$N\ \% \geq C\ \% \quad (1)$$

where C % and N % indicate respectively the contents of C and N (mass %) in the steel.

2. The martensitic stainless steel of 1., where the chemical composition further contains one or more selected from, in mass %:

Cu: 0.01% or more and 5.0% or less,
Mo: 0.01% or more and 0.50% or less, and
Co: 0.01% or more and 0.50% or less, and when Cu is 1.0% or more, Mn 0.01% or more and 1.0% or less.

3. The martensitic stainless steel of 1. or 2., where the chemical composition further contains one or more selected from, in mass %:

Ti: 0.01% or more and 0.50% or less,
Nb: 0.002% or more and less than 0.15%,
V: 0.01% or more and 0.50% or less, and
Zr: 0.01% or more and 0.50% or less.

4. The martensitic stainless steel of 3., where the Nb content is 0.002% or more and less than 0.050% and the V content is 0.01% or more and less than 0.10%, and the chemical composition satisfies a following relational expression (2), $$Nb\ \% + V\ \% \leq C\ \% + N\ \% \quad (2)$$

where C %, N %, Nb % and V % indicate respectively the contents of C, N, Nb and V (mass %) in the steel.

5. The martensitic stainless steel of 1. to 4., where the chemical composition further contains one or more selected from, in mass %:

B: 0.0002% or more and 0.0100% or less,
Ca: 0.0002% or more and 0.0100% or less, and
Mg: 0.0002% or more and 0.0100% or less.

6. The martensitic stainless steel of 1. to 5., where the martensitic stainless steel has a tensile strength of 1200 MPa or more and an elongation of 7.5% or more.

7. The martensitic stainless steel of 4. or 5., where the martensitic stainless steel has a tensile strength of 1200 MPa or more, an elongation of 7.5% or more, and an ultimate deformability of 0.7 or more.

Advantageous Effect

According to the disclosure, a martensitic stainless steel having a compatibility between excellent strength and workability, and further possessing an excellent corrosion resistance not only in cases of being performed with simply quenching treatment but also in cases of being performed with quenching-tempering treatment is obtained. The martensitic stainless steel can be suitably used in a gasket part of an automobile.

BRIEF DESCRIPTION OF THE DRAWINGS

The disclosure will be further described below with reference to the accompanying drawing, where:

FIG. 1 is a graph illustrating the evaluation results of tensile strength and elongation in steel sheets with various chemical compositions, which are plotted with respect to the C content and N content.

DETAILED DESCRIPTION

The disclosure will be described in detail below.

First, the chemical composition of the stainless steel is described. Hereinafter, the unit "%" relating to the content of elements in the chemical composition refers to "mass %" unless specified otherwise.

C: 0.020% or more and less than 0.10%

C stabilizes the austenite phase at a high temperature and increases martensite content after quenching heat treatment. Increasing martensite content highly increases strength. C highly strengthens the steel by hardening the martensite itself. This effect is obtained by containing C in a content of 0.020% or more. However, a C content of 0.10% or more tends to reduce the workability and makes it difficult to obtain an excellent strength-elongation balance. Furthermore, since C combines with Cr in the steel and precipitates as carbides, excessive increase of C reduces the Cr content dissolved in the steel, and accordingly the corrosion resistance of the steel deteriorates. Hereinafter, the Cr content dissolved in the steel is simply referred to as the Cr content in the steel unless specified otherwise. Therefore, the C content is 0.020% or more and less than 0.10%. When the C content is 0.050% or more, performing tempering heat treatment after quenching improves the workability, but significantly reduces the strength, and accordingly an excellent strength-elongation balance may not be obtained. From the perspective of this, the C content is preferably less than 0.050%.

Si: 0.01% or more and 2.0% or less

Si is an effective element to increase the strength of the steel. This effect is obtained by containing Si in a content of 0.01% or more. However, Si is also an element that makes it easier to form a ferrite phase at a high temperature. A Si content of more than 2.0% reduces the martensite content after quenching heat treatment, and accordingly a desired strength cannot be obtained. Therefore, the Si content is 0.01% or more and 2.0% or less. The Si content is preferably more than 0.3%. The Si content is preferably 1.0% or less.

Mn: 0.01% or more and 3.0% or less

Mn is an element that stabilizes the austenite phase at high temperature and is capable of increasing the martensite content after quenching heat treatment. Mn also increases the strength of the steel. These effects are obtained by containing Mn in a content of 0.01% or more. However, a Mn content of more than 3.0% or more deteriorates the workability of the steel. Therefore, the Mn content is 0.01% or more and 3.0% or less. The Mn content is preferably more than 0.3%. The Mn content is preferably 2.0% or less. The Mn content is more preferably more than 0.7%. The Mn content is more preferably 1.6% or less. In a case where the Cu content is 1.0% or more, which will be described later, however, a Mn content of more than 1.0% deteriorates both the workability and the quench hardenability of the steel. Therefore, when the Cu content is 1.0% or more, it is necessary to keep the Mn content 1.0% or less.

P: 0.050% or less

P is an element that deteriorates the toughness and its content is preferably as low as possible. Therefore, the P content is 0.050% or less. The P content is preferably 0.040% or less. The P content is more preferably 0.030% or less. The lower limit of the P content is not particularly limited. However, excessive removal of P increases manufacturing costs, and therefore its content is usually about 0.010%.

S: 0.050% or less

S is an element that deteriorates the formability and the corrosion resistance, and its content is preferably as low as possible. Therefore, the S content is 0.050% or less. The S content is preferably 0.010% or less. The S content is more preferably 0.005% or less. The lower limit of the S content is not particularly limited. However, excessive removal of S increases manufacturing costs, and therefore its content is usually about 0.001%.

Cr: 10.0% or more and 16.0% or less

Cr is an important element to secure the corrosion resistance. This effect is obtained by containing Cr in a content of 10.0% or more. On the other hand, a Cr content of more than 16.0% hardens the steel and deteriorates the manufacturability and the workability. Furthermore, since a ferrite phase is easier to be formed, the martensite content after quenching heat treatment is reduced. Reducing of martensite content reduces the strength. Therefore, the Cr content is in a range of 10.0% or more and 16.0% or less. The Cr content is preferably 11.0% or more. The Cr content is preferably 14.0% or less.

Ni: 0.01% or more and 0.80% or less

Ni is an element that stabilizes the austenite phase at a high temperature and has the effect of increasing martensite content after quenching heat treatment. It also helps to highly strengthen the steel. These effects are obtained by containing Ni in a content of 0.01% or more. On the other hand, a Ni content of more than 0.80% deteriorates the workability and accordingly an excellent strength-elongation balance cannot be obtained. Therefore, the Ni content is 0.01% or more and 0.80% or less. The Ni content is preferably less than 0.50%. The Ni content is more preferably less than 0.30%.

Al: 0.001% or more and 0.50% or less

Al is an effective element for deoxidization. This effect is obtained by containing Al in a content of 0.001% or more. However, Al is also an element that stabilizes the ferrite phase at a high temperature. When the Al content is more than 0.50%, a sufficient martensite content cannot be secured after quenching heat treatment. Therefore, the Al content is in a range of 0.001% or more and 0.50% or less. The Al content is preferably 0.02% or more. The Al content is preferably 0.35% or less. The Al content is more preferably 0.02% or more. The Al content is more preferably 0.10% or less.

N: more than 0.050% and 0.20% or less

N can greatly increase the strength of the martensitic stainless steel as the same as C, and is an important element in the disclosure. N also increases the martensite content after quenching heat treatment by stabilizing the austenite phase at a high temperature, and highly strengthens the steel by hardening the martensite itself. This effect is obtained by containing N in a content of more than 0.050%. On the other hand, a N content of more than 0.20% deteriorates the workability. Therefore, the N content is in a range of more than 0.050% and 0.20% or less. The N content is preferably more than 0.050%. The N content is preferably less than 0.12%. Furthermore, in a case where the N content is more than 0.060%, performing tempering heat treatment after quenching can increase the strength without reducing the elongation, since N precipitates as fine nitrides during the tempering heat treatment. From the perspective of this, the N content is more preferably more than 0.060%. The N content is still more preferably more than 0.070%.

In addition to satisfying the chemical composition, particularly adjusting the C content and the N content within the range, it is also very important to satisfy the following relational expression (1) regarding the C content and N content for the stainless steel of the disclosure.

$$N\,\% \geq C\,\% \quad (1)$$

where C % and N % indicate respectively the contents of C and N (mass %) in the steel.

Hereinafter, the experiments which were conducted to decide the C content and N content of the disclosure to satisfy the relational expression (1) after being adjusted within the above range will be explained.

(Experiment 1)

A steel ingot having a chemical composition of which the C and N contents are modified to a variety was smelted and casted in a vacuum melting furnace, the steel ingot also containing, in mass %, Si: 0.01% or more and 2.0% or less, Mn: 0.01% or more and 3.0% or less, P: 0.050% or less, S: 0.050% or less, Cr: 10.0% or more and 16.0% or less, Ni: 0.01% or more and 0.80% or less, and Al: 0.001% or more and 0.50% or less. After the steel ingot being heated to 1200° C., hot rolling was performed to obtain a sheet bar of 25 mm thickness×150 mm width. The sheet bar was held and softened in a furnace at 700° C. for 10 hours. Next, the sheet bar was heated to 1100° C. and hot rolled into a hot rolled sheet having a thickness of 4 mm. Next, the hot rolled sheet was held and annealed in a furnace at 700° C. for 10 hours to obtain a hot rolled annealed sheet. Next, the hot rolled annealed sheet was cold rolled into a cold rolled sheet having a thickness of 0.2 mm. The cold rolled sheet was subjected to quenching heat treatment within a temperature range from 900° C. to 1100° C. and then cooled. The cooling rate was set to 1° C./sec or more in all cases. Furthermore, for some of the cold rolled sheets, tempering heat treatment was performed within a temperature range from 200° C. to 600° C. when the sheet had cooled after the quenching heat treatment.

Using a martensitic cold-rolled stainless steel sheet (quenched material and quenched-tempered material) prepared in a way described above, a JIS No. 5 tensile test piece with its longitudinal direction parallel to the rolling direction was prepared and subjected to a room temperature tensile test to measure the tensile strength (T. S.) and elongation (EL). The original gauge distance was 50 mm and the tensile speed was 10 mm/min. The test was conducted with each steel N=2, and the average value was evaluated. The elongation (EL) was calculated by the following equation by deeply butting two broken test pieces so that the axis of the test piece was on a straight line and measuring the final gauge distance.

$$EL\ (\%)=(Lu-L0)/L0\times 100$$

where EL is the elongation (elongation after fracture), L0 is the original gauge distance and Lu is the final gauge distance.

The evaluation results are illustrated in FIG. 1, plotted with respect to the C and N contents. The meanings of circle and cross in FIG. 1 are as follows.

circle: tensile strength (T. S.)≥1200 MPa and elongation (EL)≥7.5% cross: tensile strength (T. S.)<1200 MPa and/or elongation (EL)<7.5

As illustrated in FIG. 1, adjusting the C content and N content respectively in the ranges of 0.020% or more and less than 0.10%, more than 0.050% and 0.20% or less, and to satisfy the above relational expression (1) can secure sufficient strength and obtain excellent elongation at the same time. When the C content and/or N content were out of the predetermined range, sufficient strength and/or elongation was not obtained even the relational expression (1) was satisfied.

Therefore, for the stainless steel of the disclosure, the C content and N content are adjusted respectively within the ranges and to satisfy the relational expression (1).

As described above, C and N are both effective elements that highly strengthen martensitic stainless steels. However, increasing C content deteriorates the workability significantly, and therefore it is necessary to suppress the C content. Instead of the C, increasing the content of N, which can increase the strength with less deterioration of the workability, makes it possible to achieve both excellent strength and excellent workability.

Furthermore, as illustrated in FIG. 1, even the C content and N content are adjusted respectively to the ranges of 0.020% or more and less than 0.10%, more than 0.050% and 0.20% or less, a stainless steel with high strength and high workability cannot be obtained if the relational expression (1) is not satisfied. Particularly, when N %<C %, the influence on the strength-elongation balance of the steel is dominated by C, which strengthens the steel excessively and deteriorates the workability, and accordingly the effect of N of highly strengthening the steel without deteriorating the workability is not effectively exhibited. However, by satisfying N %≥C %, N becomes the dominant factor of the strength-elongation, and the effect of achieving high strength without deteriorating the workability can be obtained. Moreover, when N %<C %, the corrosion resistance deteriorates because coarse carbides preferentially precipitate during cooling after quenching heat treatment or during tempering heat treatment. On the other hand, when N %≥C %, fine nitrides precipitate prior to the precipitation of coarse carbides. The fine nitrides have less harmful influence on the corrosion resistance of the steel than the coarse carbides, and accordingly the deterioration of corrosion resistance can be prevented.

As described above, in order to obtain a steel excellent in strength, workability (elongation) and corrosion resistance, it is necessary to make full use of the effect of N, which requires to adjust the C content and N content respectively in the ranges of 0.020% or more and less than 0.10%, more than 0.050% and 0.20% or less, and to satisfy the relational expression (1).

With respect to the relational expression (1), it is preferably N %≥1.05×C %, and more preferably N %≥1.16×C %. However, when N %>5×C %, coarse nitrides are formed, and both the strength and corrosion resistance are deteriorated. Therefore, it is preferably N %≤5×C %.

Although C and N are effective for highly increasing the strength, the effect may not be exhibited sufficiently when C %+N %<0.10%. Therefore, it is preferably C %+N %≥0.10%.

In addition to the basic components described above, the stainless steel of this disclosure can contain, if necessary, one or more selected from Cu, Mo and Co, one or more selected from Ti, Nb, V and Zr, and one or more selected from B, Ca and Mg in following ranges.

Cu: 0.01% or more and 5.0% or less

Cu precipitates finely in the steel and highly strengthens the steel during cooling of quenching heat treatment. On the other hand, since Cu precipitates finely, there is little harmful influence on the elongation. Such highly strengthening effect is obtained by containing Cu in a content of 0.01% or more. However, a Cu content of more than 5.0% not only saturates the strengthening effect, but also hardens the steel and deteriorates the workability. Therefore, when contained, the Cu content is in a range of 0.01% or more and 5.0% or less. The Cu content is preferably 0.05% or more. The Cu content is preferably 3.5% or less. The Cu content is more preferably more than 0.5%. The Cu content is more preferably 3.0% or less.

Furthermore, Cu precipitates finely in the steel and greatly increases not only the strength but also the proof stress during tempering heat treatment. This effect is obtained by containing Cu in a content of 1.0% or more. However, if the Mn content is more than 1.0% at the same time, both the workability and the quench hardenability of the steel are reduced. Therefore, when the Cu content is 1.0% or more, it is necessary to keep the Mn content 1.0% or less.

Mo: 0.01% or more and 0.50% or less

Mo is an element that increases the strength of the steel by solute strengthening. This effect is obtained by containing Mo in a content of 0.01% or more. However, Mo is expensive, and a Mo content of more than 0.50% deteriorates the workability of the steel. Therefore, when contained, the Mo content is in a range of 0.01% or more and 0.50% or less. The Mo content is preferably 0.02% or more. The Mo content is preferably 0.25% or less.

Co: 0.01% or more and 0.50% or less

Co is an element that improves the toughness of the steel. This effect is obtained by containing Co in a content of 0.01% or more. On the other hand, Co is expensive, and a Co content of more than 0.50% not only saturates the effect but also deteriorates the workability. Therefore, when contained, the Co content is in a range of 0.01% or more and 0.50% or less. The Co content is preferably 0.02% or more. The Co content is preferably 0.25% or less. The Co content is more preferably 0.02% or more. The Co content is more preferably 0.10% or less.

Ti: 0.01% or more and 0.50% or less

Ti combines with C and precipitates as carbides, and combines with N and precipitates as nitrides. This suppresses the forming of Cr carbides or Cr nitrides during cooling after quenching heat treatment, and accordingly improves the corrosion resistance of the steel. This effect is obtained by containing Ti in a content of 0.01% or more. On the other hand, when the Ti content is more than 0.50%, coarse Ti nitrides precipitate and the toughness of the steel is deteriorated. Therefore, when contained, the Ti content is in a range of 0.01% or more and 0.50% or less. The Ti content is preferably 0.02% or more. The Ti content is preferably 0.25% or less.

Nb: 0.002% or more and less than 0.15%

Nb refines grain size and improves the strength and the workability. This effect is obtained by containing Nb in a content of 0.002% or more. Furthermore, Nb combines with C and precipitates as fine carbides, which suppresses the precipitation of coarse Cr carbides and improves the ultimate deformability. In a case where a severe processing is performed locally such as the bead (convex portion) of a gasket, improving the elongation measured in a regular tensile test is a method for improving the workability. Additionally, improving the ultimate deformability is also effective. Moreover, Nb suppresses the precipitation of Cr carbides, which prevents the decrease of Cr content in the steel, and improves the corrosion resistance. On the other hand, when the Nb content is 0.15% or more, a large amount of Nb carbides precipitate, the C content dissolved in the steel is decreased, and the strength ability of martensite phase is reduced. Therefore, when contained, the Nb content is in a range of 0.002% or more and less than 0.15%. The Nb content is preferably 0.005% or more. The Nb content is more preferably 0.020% or more. The Nb content is preferably 0.100% or less. The Nb content is more preferably less than 0.050%. The Nb content is still more preferably 0.030% or less.

V: 0.01% or more and 0.50% or less

V is an effective element that improves both the strength at a high temperature and the corrosion resistance. The C and N dissolved in the steel preferentially combine with Cr and precipitate as carbides or nitrides (hereinafter, carbide and nitride may be collectively referred as carbonitride). When Cr carbonitrides precipate, the Cr content in the steel is decreased by the amount converted to carbonitrides, and the corrosion resistance of the steel is deteriorated. However, when V is contained, C and N combine with V prior to combining with Cr, and precipitate finely as V carbonitrides. Therefore, by containing V, the precipitation of Cr carbonitrides is suppressed, and the deteriorating of corrosion resistance of the steel can be prevented. Furthermore, V particularly preferentially combines with N dissolved in the steel and precipitates as fine nitrides, which suppresses the precipitation of coarse Cr nitrides and improves the ultimate deformability. The effects are obtained by containing V in a content of 0.01% or more. However, when the V content is more than 0.50%, coarse V carbonitrides precipitate, and the workability and the toughness are deteriorated. The coarse V carbonitrides also tend to be a starting point of corrosion, and thus the corrosion resistance is deteriorated on the contrary. Therefore, when contained, the V content is in a range of 0.01% or more and 0.50% or less. The V content is preferably 0.02% or more. The V content is preferably 0.25% or less. The V content is more preferably less than 0.10%. The V content is still more preferably 0.05% or less.

As described above, Nb tends to combine with C and precipitates as carbides, and V tends to combine with N and precipitates as nitrides. Therefore, by containing Nb: 0.002% or more and less than 0.050%, V: 0.01% or more and less than 0.10% at the same time, and satisfying the following relational expression (2), it is possible to further improve the ultimate deformability while maintaining high strength.

$$Nb\ \%+V\ \% \leq C\ \%+N\ \% \quad (2)$$

where C %, N %, Nb % and V % indicate respectively the contents of C, N, Nb and V (mass %) in the steel.

That is to say, since Nb and V respectively combine with C and N and precipitate as carbides and nitrides, the C content and N content in the steel are decreased with the increasing of Nb and V contents, and the strength tends to be reduced. Therefore, in order to improve the ultimate deformability while maintaining high strength, it is necessary to adjust Nb and V in a predetermined range and contain them at the same time, and to satisfy a predetermined relationship between the total contents of Nb content and V content, and the total contents of C content and N content. Specifically, it is particularly effective to satisfy the relational expression (2) with Nb: 0.002% or more and less than 0.050%, V: 0.01% or more and less than 0.10%.

Furthermore, the Nb content is preferably 0.005% or more. The Nb content is more preferably 0.020% or more. The Nb content is still more preferably 0.030% or less.

The V content is more preferably 0.02% or more. The V content is still more preferably 0.05% or less.

Regarding the relational expression (2), it is more preferably to satisfy $(Nb\ \%+V\ \%)\times 1.5 \leq C\ \%+N\ \%$.

Zr: 0.01% or More and 0.50% or Less

Zr combines with C and precipitates as carbides, and combines with N and precipitates as nitrides. This suppresses the carburization and nitridation of Cr, and accordingly improves the corrosion resistance of the steel. Furthermore, Zr also has the effect of highly strengthening the steel. The effects are obtained by containing Zr in a content of 0.01% or more. On the other hand, when the Zr content is more than 0.50%, coarse Zr carbides and nitrides precipitate, and accordingly the toughness is deteriorated. Therefore, when contained, the Zr content is in a range of 0.01% or more and 0.50% or less. The Zr content is preferably 0.02% or more. The Zr content is preferably 0.25% or less.

B: 0.0002% or More and 0.0100% or Less

B is an element that effectively improves the workability. This effect is obtained by containing B in a content of 0.0002% or more. However, a B content of more than 0.0100% deteriorates the workability and the toughness of the steel. Furthermore, B combines with N in the steel and precipitates as nitrides, by which the martensite content is decreased and the strength of the steel is reduced. Therefore, when contained, the B content is in a range of 0.0002% or more and 0.0100% or less. The B content is preferably 0.0005% or more. The B content is preferably 0.0050% or less. The B content is more preferably 0.0010% or more. The B content is more preferably 0.0030% or less.

Ca: 0.0002% or More and 0.0100% or Less

Ca is a component that effectively prevents clogging of the nozzle by precipitating inclusions that tend to form during a continuous casting. This effect is obtained by containing Ca in a content of 0.0002% or more. On the other hand, when the Ca content is more than 0.0100%, surface defects generate. Therefore, when contained, the Ca content is in a range from 0.0002% to 0.0100%. The Ca content is preferably 0.0002% or more. The Ca content is preferably 0.0030% or less. The Ca content is more preferably 0.0005% or more. The Ca content is more preferably 0.0020% or less.

Mg: 0.0002% or More and 0.0100% or Less

Mg is an element that effectively suppresses coarsening of carbonitrides. When carbonitrides precipitate coarsely, they become the origin of brittle cracks, and accordingly the toughness is deteriorated. The effect of improving toughness is obtained by containing Mg in a content of 0.0002% or more. On the other hand, when the Mg content is more than 0.0100%, the surface characteristics of the steel deteriorate.

Therefore, when contained, the Mg content is in a range of 0.0002% or more and 0.0100% or less. The Mg content is preferably 0.0002% or more. The Mg content is preferably 0.0030% or less. The Mg content is more preferably 0.0005% or more. The Mg content is more preferably 0.0020% or less.

The balance other than the above components contains Fe and incidental impurities.

For the martensitic stainless steel of the disclosure, the chemical composition is preferably to further contain, if necessary, one or more selected from Cu, Mo and Co, one or more selected from Ti, Nb, V and Zr, and one or more selected from B, Ca and Mg at a predetermined content in addition to the aforementioned basic components, the balance containing Fe and incidental impurities.

The structure of the martensitic stainless steel of the disclosure is mainly in a martensite phase in order to obtain a high-strength material of 1200 MPa or more. Specifically, 80% or more in volume ratio of the entire structure is in a martensite phase, and the balance is in a ferrite phase and/or a retained austenite phase. It is preferably, however, that 90% or more in volume ratio is martensite, even in a martensite single phase.

Regarding the volume ratio of the martensite phase, it is determined by preparing a test piece for cross-section observation from final cold rolled sheet after quenching or tempering, subjecting it to etching treatment with aqua regia, then observing 10 fields of view under an optical microscope at 100 times magnification, distinguishing the martensite phase, ferrite phase and retained austenite phase from the structure shape and etching strength, then obtaining the volume ratios of the martensite phase by image processing, and calculating the average value.

The following describes a suitable production method for the presently disclosed martensitic stainless steel.

The martensitic stainless steel can be produced by melting a steel containing the aforementioned chemical composition in a melting furnace such as a converter or an electric heating furnace, subjecting it to secondary refining such as ladle refining and vacuum refining, obtaining a slab by continuous casting method or ingoting-blooming method, subjecting it to hot rolling, hot band annealing, pickling to obtain a hot rolled annealed sheet, and then performing cold rolling, quenching heat treatment, and all steps of pickling, tempering heat treatment, etc if necessary to obtain a cold rolled sheet.

For example, a molten steel is melted in a converter or an electric heating furnace or the like, and is subjected to secondarily refining by VOD method or AOD method to obtain the aforementioned chemical composition, and then a slab is obtained by continuous casting method. At this time, in order to decrease the C content and increase the N content and to keep the N content equal to or more than the C content, nitrogen-containing raw materials such as chromium nitride is added or nitrogen gas is blowed, if necessary, to keep the N content at a predetermined value. The slab is heated to 1000° C. to 1250° C. to obtain a hot rolled sheet of desired thickness by hot rolling. The hot rolled sheet is subjected to batch annealing at a temperature of 600° C. to 800° C., and then oxide scale is removed by shot blasting and pickling to obtain a hot rolled annealed sheet. The hot rolled annealed sheet is further subject to cold rolling, quenching heat treatment and then cools to obtain a cold rolled sheet. In the cold rolling step, two or more times of cold rolling including intermediate annealing may be performed if necessary. The total rolling reduction in the cold rolling step containing one or more times of cold rolling is 60% or more, preferably 80% or more. In order to obtain the desired properties (strength and elongation), the quenching heat treatment is preferably conducted under a temperature range from 900° C. to 1200° C. The quenching heat treatment temperature is more preferably 950° C. or more. The quenching heat treatment temperature is more preferably 1100° C. or less. The cooling rate after quenching heat treatment is preferably 1° C./sec or more in order to obtain a desired strength. Tempering heat treatment may be performed, if necessary, when the sheet has cooled after quenching heat treatment. Furthermore, in order to obtain desired properties, the tempering heat treatment is preferably conducted under a temperature range from 200° C. to 600° C. The tempering heat treatment temperature is more preferably 300° C. or more. The tempering heat treatment temperature is more preferably 500° C. or less. Pickling treatment may be performed after the quenching heat treatment and the tempering heat treatment. Furthermore, by performing the quenching heat treatment and the tempering heat treatment in a reducing atmosphere containing hydrogen, BA finishing without pickling may be used.

Cold rolled sheets produced in such way are subjected to a bending process, a beading process, a drilling process or the like according to respective uses, and to form gasket parts or the like used as sealing materials between the engine and the exhaust system part of an automobile. Additionally, the sheets can also be used in members that require springiness. If necessary, the formed parts may be subjected to quenching heat treatment.

Examples 30 kg of steel ingot having the chemical compositions listed in Table 1 was smelted and casted in a vacuum melting furnace. After the steel ingot being heated to 1200° C., hot rolling was performed to obtain a sheet bar of 25 mm thickness×150 mm width. The sheet bar was held and softened in a furnace at 700° C. for 10 hours. Next, the sheet bar was heated to 1100° C. and hot rolled into a hot rolled sheet having a thickness of 4 mm. Next, the hot rolled sheet was held and annealed in a furnace at 700° C. for 10 hours to obtain a hot rolled annealed sheet. Next, the hot rolled annealed sheet was cold rolled into a cold rolled sheet having a thickness of 0.2 mm, and was subjected to quenching heat treatment at the temperatures listed in Table 2, and then cooled. The cooling rate was set to 1° C./sec or more in all cases. Furthermore, for some of the cold rolled sheets, tempering heat treatment was performed at the temperatures listed in Table 2 when the sheet had cooled after the quenching heat treatment.

(Structure Observation)

For martensitic stainless steel cold rolled sheets (quenched material and quenched-tempered material) prepared in a way described above, prepare a test piece for cross-section observation, subject it to etching treatment with aqua regia, then observe 10 fields of view under an optical microscope at 100 times magnification, distinguish the martensite phase and ferrite phase from the structure shape and etching strength, then obtain the volume ratios of the martensite phase by image processing, and calculate the average value. In examples No. 1 to 58 and examples No. 73 to 82, 80% or more in volume ratio of the entire structure was in a martensite phase. In comparative examples No. 59, No. 60, No. 61, No. 63, No. 64, No. 67 to 69, No. 71 and No. 72, 80% or more in volume ratio of the entire structure was in a martensite phase as well. On the other hand, in comparative examples No. 62, No. 65, No. 66 and No. 70, less than 80% in volume ratio of the entire structure was in a martensite phase.

(Tensile Test)

Using a martensitic stainless steel cold rolled sheet (quenched material and quenched-tempered material) prepared in a way described above, a JIS No. 5 tensile test piece with its longitudinal direction parallel to the rolling direction was prepared and subjected to room temperature tensile test according to JIS Z2241, the tensile strength (T.S.), proof stress (P.S.), elongation (EL) and ultimate deformability ($\varepsilon_1$) were measured. The original gauge distance was 50 mm and the tensile speed was 10 mm/min. The test was conducted with each steel N=2, and the average value was evaluated.

The elongation (EL) was calculated by the following expression by deeply butting two broken test pieces so that the axis of the test piece was on a straight line, and measuring the final gauge distance.

$$EL\ (\%)=(Lu-L0)/L0\times 100$$

where EL is the elongation (elongation after fracture), L0 is the original gauge distance and Lu is the final gauge distance.

The plate width W and plate thickness T on the fractured surface of the tensile test piece after the tensile test were measured, and the ultimate deformability $\varepsilon_1$ was calculated by the following expression together with the plate width $W_0$ and plate thickness $T_0$ of the tensile test piece before the tensile test.

$$\varepsilon_1=-\{\ln(W/W_0)+\ln(T/T_0)\}$$

where $\varepsilon_1$ is the ultimate deformability, W is the plate width on the fractured surface of the tensile test piece after the tensile test, $W_0$ is the plate width of the tensile test piece before the tensile test, T is the plate thickness on the fractured surface of the tensile test piece after the tensile test, and $T_0$ is the plate thickness of the tensile test piece before the tensile test.

The evaluation results are listed in Table 2. The evaluation criteria are as follows.

Tensile Strength (TS)

Excellent: passed and particularly excellent 1400 MPa or more

Good: passed 1200 MPa or more and less than 1400 MPa

Poor: failed less than 1200 MPa

Elongation (EL)

Excellent: passed and particularly excellent 8.5% or more

Good: passed 7.5% or more and less than 8.5%

Poor: failed less than 7.5%

Proof Stress (P.S.)

Excellent: passed and particularly excellent 1150 MPa or more

Good: passed 1050 MPa or more and less than 1150 MPa

Poor: failed less than 1050 MPa

Ultimate Deformability ($\varepsilon_1$)

Excellent: passed and particularly excellent 0.7 or more

Good: passed 0.5 or more and less than 0.7

Poor: failed less than 0.5

(Corrosion Resistance Evaluation Test)

A test piece of 60 mm width×80 mm length was cut from a cold rolled sheet (quenched material and quenched-tempered material) prepared in a way described above, and a corrosion resistance evaluation test was conducted according to Corrosion Test Method for Automotive Materials of JASO Standards (JASO M 609-91). The surface of the test piece was polished with No. 600 emery paper. The entire back surface and 5 mm around the surface were covered with a seal. In the test, the corrosion area ratio of the surface was measured after fifteen cycles, where one cycle includes two hours of 5% salt water spraying, four hours of 60° C. drying, and two hours of 50° C. wetting. Additionally, in the test, N=2, and the larger corrosion area ratio was seen as the evaluation of the cold rolled sheet.

The obtained results are listed in Table 2. The evaluation criteria are as follows.

Excellent: passed and particularly excellent corrosion area ratio being less than 30%

Good: passed corrosion area ratio being 30% or more and less than 60%

Poor: failed corrosion area ratio being 60% or more

TABLE 1

| Steel | chemical composition (mass %) | | | | | | | | | | | |
|---|---|---|---|---|---|---|---|---|---|---|---|---|
| No. | C | Si | Mn | P | S | Cr | Ni | Al | N | Cu | Mo | Co |
| 1 | 0.044 | 0.36 | 0.46 | 0.022 | 0.004 | 12.9 | 0.08 | 0.02 | 0.108 | — | — | — |
| 2 | 0.041 | 0.55 | 1.10 | 0.029 | 0.002 | 11.1 | 0.12 | 0.01 | 0.093 | — | — | — |
| 3 | 0.041 | 0.58 | 0.35 | 0.030 | 0.002 | 11.9 | 0.10 | 0.03 | 0.071 | — | — | — |
| 4 | 0.095 | 0.56 | 0.88 | 0.028 | 0.001 | 13.3 | 0.13 | 0.02 | 0.101 | — | — | — |
| 5 | 0.027 | 0.32 | 1.45 | 0.034 | 0.001 | 14.2 | 0.09 | 0.02 | 0.120 | — | — | — |
| 6 | 0.043 | 0.43 | 1.05 | 0.032 | 0.003 | 15.6 | 0.19 | 0.04 | 0.109 | — | — | — |
| 7 | 0.063 | 0.58 | 1.21 | 0.026 | 0.003 | 10.9 | 0.15 | 0.05 | 0.076 | — | — | — |
| 8 | 0.089 | 1.58 | 0.67 | 0.028 | 0.003 | 12.4 | 0.09 | 0.09 | 0.119 | — | — | — |
| 9 | 0.043 | 0.43 | 2.42 | 0.027 | 0.002 | 14.3 | 0.18 | 0.15 | 0.106 | — | — | — |
| 10 | 0.038 | 0.42 | 0.38 | 0.028 | 0.003 | 14.5 | 0.64 | 0.02 | 0.102 | — | — | — |
| 11 | 0.040 | 0.51 | 1.25 | 0.040 | 0.002 | 12.6 | 0.07 | 0.03 | 0.163 | — | — | — |
| 12 | 0.042 | 0.44 | 1.52 | 0.028 | 0.002 | 11.6 | 0.19 | 0.04 | 0.093 | — | — | — |
| 13 | 0.065 | 0.51 | 1.37 | 0.035 | 0.001 | 12.5 | 0.17 | 0.28 | 0.081 | — | — | — |
| 14 | 0.045 | 0.55 | 0.69 | 0.030 | 0.002 | 11.4 | 0.08 | 0.08 | 0.135 | — | — | — |
| 15 | 0.049 | 0.32 | 1.54 | 0.026 | 0.002 | 11.1 | 0.12 | 0.02 | 0.127 | — | — | — |
| 16 | 0.039 | 0.33 | 0.62 | 0.035 | 0.002 | 12.4 | 0.20 | 0.01 | 0.070 | — | 0.25 | — |
| 17 | 0.044 | 0.37 | 0.96 | 0.032 | 0.002 | 14.3 | 0.12 | 0.01 | 0.103 | — | — | — |
| 18 | 0.038 | 0.41 | 1.15 | 0.040 | 0.003 | 10.6 | 0.20 | 0.02 | 0.087 | — | — | — |
| 19 | 0.049 | 0.51 | 0.37 | 0.038 | 0.002 | 11.2 | 0.14 | 0.05 | 0.062 | — | — | — |
| 20 | 0.042 | 0.30 | 0.37 | 0.035 | 0.002 | 12.1 | 0.07 | 0.10 | 0.109 | — | — | — |
| 21 | 0.036 | 0.33 | 0.71 | 0.029 | 0.003 | 12.6 | 0.14 | 0.03 | 0.107 | — | — | 0.04 |
| 22 | 0.037 | 0.39 | 0.59 | 0.033 | 0.002 | 12.3 | 0.19 | 0.02 | 0.074 | — | — | — |
| 23 | 0.045 | 0.34 | 1.16 | 0.031 | 0.002 | 10.9 | 0.17 | 0.02 | 0.088 | — | — | — |
| 24 | 0.039 | 0.30 | 0.96 | 0.034 | 0.003 | 11.6 | 0.13 | 0.07 | 0.084 | 1.98 | — | — |
| 25 | 0.040 | 0.51 | 0.86 | 0.025 | 0.001 | 13.3 | 0.08 | 0.02 | 0.100 | 3.52 | — | — |

TABLE 1-continued

| | | | | | | | | | | | | |
|---|---|---|---|---|---|---|---|---|---|---|---|---|
| 26 | 0.039 | 0.51 | 0.75 | 0.026 | 0.001 | 12.6 | 0.14 | 0.01 | 0.096 | 2.80 | — | — |
| 27 | 0.044 | 0.33 | 0.83 | 0.036 | 0.002 | 11.3 | 0.07 | 0.05 | 0.085 | 1.69 | — | — |
| 28 | 0.044 | 0.56 | 0.96 | 0.036 | 0.002 | 10.6 | 0.19 | 0.03 | 0.081 | 1.47 | — | — |
| 29 | 0.037 | 0.39 | 0.98 | 0.032 | 0.002 | 12.3 | 0.20 | 0.05 | 0.106 | 3.48 | — | — |
| 30 | 0.043 | 0.39 | 0.81 | 0.036 | 0.003 | 13.0 | 0.17 | 0.24 | 0.086 | 3.08 | — | — |
| 31 | 0.040 | 0.34 | 0.79 | 0.031 | 0.002 | 10.6 | 0.08 | 0.19 | 0.099 | 2.22 | — | — |
| 32 | 0.049 | 0.49 | 0.88 | 0.029 | 0.003 | 13.3 | 0.06 | 0.09 | 0.074 | 2.95 | — | — |
| 33 | 0.046 | 0.57 | 0.34 | 0.040 | 0.002 | 13.5 | 0.06 | 0.07 | 0.086 | 3.89 | 0.31 | — |
| 34 | 0.042 | 0.37 | 0.66 | 0.034 | 0.002 | 10.7 | 0.07 | 0.02 | 0.098 | 3.57 | — | — |
| 35 | 0.044 | 0.47 | 0.95 | 0.034 | 0.001 | 11.1 | 0.18 | 0.05 | 0.109 | 4.20 | — | — |
| 36 | 0.048 | 0.49 | 0.90 | 0.035 | 0.002 | 13.8 | 0.05 | 0.07 | 0.100 | 1.88 | — | — |
| 37 | 0.047 | 0.50 | 0.94 | 0.035 | 0.002 | 14.2 | 0.11 | 0.02 | 0.085 | 2.10 | — | — |
| 38 | 0.036 | 0.59 | 0.66 | 0.039 | 0.003 | 12.3 | 0.10 | 0.03 | 0.072 | 4.28 | — | — |
| 39 | 0.040 | 0.31 | 0.92 | 0.027 | 0.003 | 12.3 | 0.14 | 0.05 | 0.080 | 3.87 | — | 0.03 |
| 40 | 0.042 | 0.36 | 0.90 | 0.032 | 0.002 | 11.5 | 0.09 | 0.01 | 0.072 | 1.43 | — | — |
| 41 | 0.073 | 0.48 | 0.72 | 0.029 | 0.002 | 12.1 | 0.20 | 0.01 | 0.084 | 0.55 | — | — |
| 42 | 0.049 | 0.40 | 0.33 | 0.038 | 0.001 | 14.2 | 0.28 | 0.01 | 0.094 | 0.96 | — | — |
| 43 | 0.049 | 0.34 | 0.71 | 0.035 | 0.002 | 13.6 | 0.18 | 0.10 | 0.082 | — | — | — |
| 44 | 0.040 | 0.51 | 0.51 | 0.035 | 0.002 | 10.6 | 0.09 | 0.13 | 0.071 | — | — | — |
| 45 | 0.041 | 0.54 | 1.50 | 0.026 | 0.003 | 12.1 | 0.05 | 0.08 | 0.104 | — | — | — |
| 46 | 0.038 | 0.42 | 1.48 | 0.031 | 0.001 | 13.9 | 0.20 | 0.02 | 0.082 | — | — | — |
| 47 | 0.040 | 0.47 | 0.31 | 0.026 | 0.003 | 14.1 | 0.07 | 0.02 | 0.090 | — | — | — |
| 48 | 0.045 | 0.42 | 0.33 | 0.035 | 0.003 | 13.0 | 0.17 | 0.03 | 0.083 | 2.80 | — | — |
| 49 | 0.049 | 0.59 | 1.57 | 0.032 | 0.003 | 12.0 | 0.13 | 0.07 | 0.093 | — | — | — |
| 50 | 0.043 | 0.43 | 1.56 | 0.032 | 0.003 | 11.2 | 0.07 | 0.05 | 0.087 | — | — | — |
| 51 | 0.038 | 0.57 | 0.98 | 0.038 | 0.003 | 12.9 | 0.06 | 0.06 | 0.102 | — | — | — |
| 52 | 0.036 | 0.51 | 0.65 | 0.034 | 0.002 | 11.9 | 0.07 | 0.11 | 0.076 | — | 0.19 | — |
| 53 | 0.036 | 0.45 | 1.49 | 0.038 | 0.001 | 11.4 | 0.19 | 0.02 | 0.109 | — | — | — |
| 54 | 0.046 | 0.60 | 1.14 | 0.031 | 0.001 | 13.4 | 0.05 | 0.03 | 0.093 | — | — | — |
| 55 | 0.042 | 0.42 | 1.54 | 0.035 | 0.002 | 12.4 | 0.10 | 0.02 | 0.097 | — | — | — |
| 56 | 0.041 | 0.56 | 0.37 | 0.025 | 0.002 | 14.2 | 0.16 | 0.04 | 0.082 | — | — | — |
| 57 | 0.042 | 0.51 | 0.58 | 0.028 | 0.003 | 13.1 | 0.08 | 0.01 | 0.083 | — | — | 0.05 |
| 58 | 0.045 | 0.49 | 0.58 | 0.025 | 0.001 | 11.2 | 0.12 | 0.02 | 0.078 | — | — | — |
| 59 | 0.128 | 0.35 | 0.46 | 0.020 | 0.004 | 12.7 | 0.07 | 0.09 | 0.031 | — | — | — |
| 60 | 0.113 | 0.56 | 1.57 | 0.028 | 0.003 | 14.0 | 0.10 | 0.03 | 0.088 | — | — | — |
| 61 | 0.095 | 0.60 | 0.86 | 0.035 | 0.002 | 11.5 | 0.11 | 0.04 | 0.071 | — | — | — |
| 62 | 0.041 | 2.18 | 0.63 | 0.034 | 0.001 | 12.7 | 0.22 | 0.02 | 0.070 | — | — | — |
| 63 | 0.047 | 0.31 | 3.36 | 0.030 | 0.001 | 13.8 | 0.09 | 0.10 | 0.100 | — | — | — |
| 64 | 0.068 | 0.40 | 1.55 | 0.034 | 0.001 | 11.6 | 0.28 | 0.15 | 0.083 | 1.98 | — | — |
| 65 | 0.024 | 0.56 | 0.99 | 0.033 | 0.001 | 11.5 | 0.27 | 0.02 | 0.028 | — | — | — |
| 66 | 0.047 | 0.58 | 0.66 | 0.033 | 0.002 | 16.7 | 0.18 | 0.07 | 0.093 | — | — | — |
| 67 | 0.089 | 0.47 | 1.22 | 0.036 | 0.001 | 11.4 | 0.14 | 0.05 | 0.073 | — | — | — |
| 68 | 0.108 | 0.47 | 1.22 | 0.036 | 0.001 | 11.4 | 0.14 | 0.06 | 0.123 | — | — | — |
| 69 | 0.119 | 0.47 | 1.22 | 0.036 | 0.001 | 11.4 | 0.14 | 0.03 | 0.123 | — | — | — |
| 70 | 0.039 | 0.35 | 0.99 | 0.026 | 0.002 | 11.3 | 0.14 | 0.06 | 0.074 | — | — | — |
| 71 | 0.048 | 0.56 | 0.65 | 0.038 | 0.001 | 9.3 | 0.18 | 0.08 | 0.107 | — | — | — |
| 72 | 0.052 | 0.49 | 0.66 | 0.032 | 0.001 | 14.1 | 0.87 | 0.02 | 0.089 | — | — | — |
| 73 | 0.048 | 0.36 | 0.48 | 0.035 | 0.002 | 12.8 | 0.08 | 0.03 | 0.104 | — | — | — |
| 74 | 0.046 | 0.47 | 0.32 | 0.028 | 0.001 | 12.1 | 0.11 | 0.10 | 0.113 | — | — | — |
| 75 | 0.049 | 0.28 | 0.55 | 0.030 | 0.003 | 11.7 | 0.09 | 0.05 | 0.089 | 0.42 | — | — |
| 76 | 0.039 | 0.35 | 0.41 | 0.030 | 0.002 | 13.0 | 0.07 | 0.04 | 0.096 | — | — | — |
| 77 | 0.049 | 0.78 | 0.45 | 0.032 | 0.002 | 13.4 | 0.12 | 0.04 | 0.106 | — | — | — |
| 78 | 0.045 | 0.18 | 0.56 | 0.025 | 0.002 | 12.5 | 0.10 | 0.02 | 0.108 | — | — | — |
| 79 | 0.053 | 0.44 | 0.37 | 0.034 | 0.001 | 11.9 | 0.08 | 0.03 | 0.094 | — | — | 0.02 |
| 80 | 0.077 | 0.52 | 0.22 | 0.036 | 0.003 | 13.3 | 0.22 | 0.02 | 0.099 | — | — | — |
| 81 | 0.061 | 0.34 | 0.44 | 0.032 | 0.003 | 12.4 | 0.05 | 0.05 | 0.088 | — | — | — |
| 82 | 0.045 | 0.38 | 0.50 | 0.033 | 0.002 | 11.8 | 0.14 | 0.04 | 0.082 | — | 0.25 | — |
| 83 | 0.040 | 0.61 | 0.28 | 0.029 | 0.002 | 12.3 | 0.12 | 0.03 | 0.073 | — | — | — |

| Steel | chemical composition (mass %) | | | | | | | | | |
|---|---|---|---|---|---|---|---|---|---|---|
| No. | Ti | Nb | V | Zr | B | Ca | Mg | N %/C % | (C % + N %)*/ (Nb % + V %) | Remarks |
| 1 | — | — | — | — | — | — | — | 2.45 | — | Example |
| 2 | — | — | — | — | — | — | — | 2.28 | — | Example |
| 3 | — | — | — | — | — | — | — | 1.72 | — | Example |
| 4 | — | — | — | — | — | — | — | 1.07 | — | Example |
| 5 | — | — | — | — | — | — | — | 4.44 | — | Example |
| 6 | — | — | — | — | — | — | — | 2.54 | — | Example |
| 7 | — | — | — | — | — | — | — | 1.21 | — | Example |
| 8 | — | — | — | — | — | — | — | 1.34 | — | Example |
| 9 | — | — | — | — | — | — | — | 2.45 | — | Example |
| 10 | — | — | — | — | — | — | — | 2.67 | — | Example |
| 11 | — | — | — | — | — | — | — | 4.10 | — | Example |
| 12 | — | — | — | — | — | — | — | 2.22 | — | Example |
| 13 | — | — | — | — | — | — | — | 1.25 | — | Example |
| 14 | — | 0.143 | — | — | — | — | — | 3.00 | — | Example |
| 15 | 0.14 | — | — | — | — | — | — | 2.59 | — | Example |
| 16 | — | — | — | — | — | — | — | 1.77 | — | Example |
| 17 | — | — | — | 0.09 | — | — | — | 2.34 | — | Example |

TABLE 1-continued

| | | | | | | | | | | |
|---|---|---|---|---|---|---|---|---|---|---|
| 18 | — | — | — | — | 0.0014 | — | — | 2.27 | — | Example |
| 19 | — | — | — | — | — | — | 0.0009 | 1.26 | — | Example |
| 20 | — | — | — | — | — | 0.0008 | — | 2.63 | — | Example |
| 21 | — | — | — | — | — | — | — | 3.01 | — | Example |
| 22 | — | — | — | — | — | 0.0008 | 0.0011 | 2.00 | — | Example |
| 23 | 0.07 | 0.095 | — | — | — | — | — | 1.95 | — | Example |
| 24 | — | — | — | — | — | — | — | 2.16 | — | Example |
| 25 | — | — | — | — | — | — | — | 2.51 | — | Example |
| 26 | — | — | — | — | — | — | — | 2.45 | — | Example |
| 27 | — | — | — | — | — | — | — | 1.93 | — | Example |
| 28 | — | — | — | — | — | — | — | 1.82 | — | Example |
| 29 | — | — | — | — | — | — | — | 2.84 | — | Example |
| 30 | — | — | — | — | — | — | — | 1.98 | — | Example |
| 31 | — | 0.122 | — | — | — | — | — | 2.51 | — | Example |
| 32 | 0.22 | — | — | — | — | — | — | 1.50 | — | Example |
| 33 | — | — | — | — | — | — | — | 1.85 | — | Example |
| 34 | — | — | 0.19 | — | — | — | — | 2.35 | — | Example |
| 35 | — | — | — | 0.07 | — | — | — | 2.50 | — | Example |
| 36 | — | — | — | — | 0.0012 | — | — | 2.06 | — | Example |
| 37 | — | — | — | — | — | — | 0.0007 | 1.81 | — | Example |
| 38 | — | — | — | — | — | 0.0010 | — | 2.03 | — | Example |
| 39 | — | — | — | — | — | — | — | 1.99 | — | Example |
| 40 | — | 0.055 | — | — | 0.0018 | — | — | 1.69 | — | Example |
| 41 | — | — | — | — | — | — | — | 1.15 | — | Example |
| 42 | — | — | — | — | — | — | — | 1.93 | — | Example |
| 43 | — | — | 0.26 | — | — | — | — | 1.66 | — | Example |
| 44 | — | — | 0.07 | — | — | — | — | 1.75 | — | Example |
| 45 | — | — | 0.17 | — | — | — | — | 2.53 | — | Example |
| 46 | — | — | 0.41 | — | — | — | — | 2.14 | — | Example |
| 47 | — | — | 0.32 | — | — | — | — | 2.23 | — | Example |
| 48 | — | — | 0.05 | — | — | — | — | 1.84 | — | Example |
| 49 | — | — | 0.32 | — | — | — | — | 1.91 | — | Example |
| 50 | — | 0.087 | 0.16 | — | — | — | — | 2.02 | 0.5 | Example |
| 51 | 0.08 | — | 0.10 | — | — | — | — | 2.68 | — | Example |
| 52 | — | — | 0.39 | — | — | — | — | 2.10 | — | Example |
| 53 | — | — | 0.19 | 0.04 | — | — | — | 3.04 | — | Example |
| 54 | — | — | 0.14 | — | 0.0015 | — | — | 2.01 | — | Example |
| 55 | — | — | 0.33 | — | — | — | 0.0008 | 2.33 | — | Example |
| 56 | — | — | 0.06 | — | — | 0.0011 | — | 1.99 | — | Example |
| 57 | — | — | 0.16 | — | — | — | — | 1.97 | — | Example |
| 58 | — | — | — | — | — | — | — | 1.74 | — | Example |
| 59 | — | — | — | — | — | — | — | 0.24 | — | Comparative example |
| 60 | — | — | — | — | — | — | — | 0.78 | — | Comparative example |
| 61 | — | — | — | — | — | — | — | 0.75 | — | Comparative example |
| 62 | — | — | — | — | — | — | — | 1.70 | — | Comparative example |
| 63 | — | — | — | — | — | — | — | 2.12 | — | Comparative example |
| 64 | — | — | — | — | — | — | — | 1.22 | — | Comparative example |
| 65 | — | — | — | — | — | — | — | 1.17 | — | Comparative example |
| 66 | — | — | — | — | — | — | — | 1.98 | — | Comparative example |
| 67 | — | — | — | — | — | — | — | 0.82 | — | Comparative example |
| 68 | — | — | — | — | — | — | — | 1.14 | — | Comparative example |
| 69 | — | — | — | — | — | — | — | 1.03 | — | Comparative example |
| 70 | — | — | 0.88 | — | — | — | — | 1.88 | — | Comparative example |
| 71 | — | — | — | — | — | — | — | 2.22 | — | Comparative example |
| 72 | — | — | — | — | — | — | — | 1.71 | — | Comparative example |
| 73 | — | 0.022 | 0.03 | — | — | — | — | 2.17 | 2.9 | Example |
| 74 | — | 0.006 | 0.08 | — | — | — | — | 2.46 | 1.8 | Example |
| 75 | — | 0.010 | 0.03 | — | — | — | — | 1.82 | 3.5 | Example |
| 76 | — | 0.048 | 0.01 | 0.03 | — | — | — | 2.46 | 2.3 | Example |
| 77 | — | 0.029 | 0.02 | — | — | — | 0.0012 | 2.16 | 3.2 | Example |
| 78 | — | 0.018 | 0.05 | — | — | 0.0011 | — | 2.40 | 2.3 | Example |
| 79 | — | 0.033 | 0.02 | — | — | — | — | 1.77 | 2.8 | Example |
| 80 | 0.02 | 0.020 | 0.02 | — | — | — | — | 1.29 | 4.4 | Example |
| 81 | — | 0.042 | 0.04 | — | 0.0009 | — | — | 1.44 | 1.8 | Example |
| 82 | — | 0.009 | 0.01 | — | — | — | — | 1.82 | 6.7 | Example |
| 83 | — | 0.045 | 0.08 | — | — | — | — | 1.83 | 0.9 | Example |

*only in cases where Nb: 0.002% or more and less than 0.050%, and V: 0.01% or more and less than 0.10%

TABLE 2

| | Producing conditions | | Evaluation results | | | | | |
|---|---|---|---|---|---|---|---|---|
| Steel No. | Quenching temperature (° C.) | Tempering temperature (° C.) | Tensile strength | Poof stress | Elongation | Ultimate deformability | Corrosion resistance | Remarks |
| 1 | 1000 | 300 | Excellent | Good | Excellent | Good | Good | Example |
| 2 | 950 | 400 | Excellent | Good | Excellent | Good | Good | Example |

TABLE 2-continued

| Steel No. | Producing conditions: Quenching temperature (° C.) | Producing conditions: Tempering temperature (° C.) | Evaluation results: Tensile strength | Evaluation results: Poof stress | Evaluation results: Elongation | Evaluation results: Ultimate deformability | Evaluation results: Corrosion resistance | Remarks |
|---|---|---|---|---|---|---|---|---|
| 3 | 1030 | no tempering | Good | Good | Excellent | Good | Good | Example |
| 4 | 980 | no tempering | Good | Good | Good | Good | Good | Example |
| 5 | 1050 | 200 | Excellent | Good | Excellent | Good | Good | Example |
| 6 | 1000 | 500 | Excellent | Good | Excellent | Good | Good | Example |
| 7 | 950 | no tempering | Good | Good | Good | Good | Good | Example |
| 8 | 930 | no tempering | Good | Good | Good | Good | Good | Example |
| 9 | 1100 | no tempering | Good | Good | Excellent | Good | Good | Example |
| 10 | 1050 | no tempering | Good | Good | Excellent | Good | Good | Example |
| 11 | 1000 | no tempering | Good | Good | Excellent | Good | Good | Example |
| 12 | 1080 | 200 | Excellent | Good | Excellent | Good | Good | Example |
| 13 | 1030 | no tempering | Good | Good | Good | Good | Good | Example |
| 14 | 1030 | no tempering | Good | Good | Excellent | Good | Good | Example |
| 15 | 1000 | no tempering | Good | Good | Excellent | Good | Good | Example |
| 16 | 1150 | no tempering | Good | Good | Excellent | Good | Good | Example |
| 17 | 980 | 400 | Excellent | Good | Excellent | Good | Good | Example |
| 18 | 950 | no tempering | Good | Good | Excellent | Good | Good | Example |
| 19 | 1000 | no tempering | Good | Good | Excellent | Good | Good | Example |
| 20 | 1030 | no tempering | Good | Good | Excellent | Good | Good | Example |
| 21 | 1100 | no tempering | Good | Good | Excellent | Good | Good | Example |
| 22 | 950 | no tempering | Good | Good | Excellent | Good | Good | Example |
| 23 | 1000 | no tempering | Good | Good | Excellent | Good | Good | Example |
| 24 | 980 | 500 | Excellent | Excellent | Excellent | Good | Good | Example |
| 25 | 1000 | no tempering | Good | Excellent | Excellent | Good | Good | Example |
| 26 | 1030 | 600 | Excellent | Excellent | Excellent | Good | Good | Example |
| 27 | 1000 | 500 | Excellent | Excellent | Excellent | Good | Good | Example |
| 28 | 1000 | no tempering | Good | Excellent | Excellent | Good | Good | Example |
| 29 | 1030 | 200 | Excellent | Excellent | Excellent | Good | Good | Example |
| 30 | 1030 | no tempering | Good | Excellent | Excellent | Good | Good | Example |
| 31 | 1030 | no tempering | Good | Excellent | Excellent | Good | Good | Example |
| 32 | 980 | no tempering | Good | Excellent | Excellent | Good | Good | Example |
| 33 | 1030 | 400 | Excellent | Excellent | Excellent | Good | Good | Example |
| 34 | 1000 | no tempering | Good | Excellent | Excellent | Good | Excellent | Example |
| 35 | 980 | no tempering | Good | Excellent | Excellent | Good | Good | Example |
| 36 | 1030 | 300 | Excellent | Excellent | Excellent | Good | Good | Example |
| 37 | 1030 | no tempering | Good | Excellent | Excellent | Good | Good | Example |
| 38 | 1000 | no tempering | Good | Excellent | Excellent | Good | Good | Example |
| 39 | 980 | no tempering | Good | Excellent | Excellent | Good | Good | Example |
| 40 | 1030 | no tempering | Good | Excellent | Excellent | Good | Good | Example |
| 41 | 1000 | no tempering | Good | Excellent | Good | Good | Good | Example |
| 42 | 980 | no tempering | Good | Excellent | Excellent | Good | Good | Example |
| 43 | 1000 | no tempering | Good | Good | Excellent | Good | Excellent | Example |
| 44 | 980 | 300 | Excellent | Good | Excellent | Good | Excellent | Example |
| 45 | 1000 | no tempering | Good | Good | Excellent | Good | Excellent | Example |
| 46 | 1030 | no tempering | Good | Good | Excellent | Good | Excellent | Example |
| 47 | 1030 | 200 | Excellent | Good | Excellent | Good | Excellent | Example |
| 48 | 980 | 600 | Excellent | Excellent | Excellent | Good | Excellent | Example |
| 49 | 1050 | no tempering | Good | Good | Excellent | Good | Excellent | Example |
| 50 | 1000 | no tempering | Good | Good | Excellent | Good | Excellent | Example |
| 51 | 1030 | no tempering | Good | Good | Excellent | Good | Excellent | Example |
| 52 | 1080 | no tempering | Good | Good | Excellent | Good | Excellent | Example |
| 53 | 1050 | no tempering | Good | Good | Excellent | Good | Excellent | Example |
| 54 | 1030 | no tempering | Good | Good | Excellent | Good | Excellent | Example |
| 55 | 1030 | no tempering | Good | Good | Excellent | Good | Excellent | Example |
| 56 | 1030 | 400 | Excellent | Good | Excellent | Good | Excellent | Example |
| 57 | 1100 | no tempering | Good | Good | Excellent | Good | Excellent | Example |
| 58 | 1000 | no tempering | Good | Good | Excellent | Good | Good | Example |
| 59 | 1030 | no tempering | Good | Good | Poor | Poor | Poor | Comparative example |
| 60 | 1050 | no tempering | Good | Good | Poor | Poor | Poor | Comparative example |
| 61 | 1000 | 500 | Poor | Poor | Good | Poor | Good | Comparative example |
| 62 | 980 | no tempering | Poor | Poor | Good | Poor | Good | Comparative example |
| 63 | 1030 | no tempering | Good | Good | Poor | Poor | Good | Comparative example |
| 64 | 1050 | no tempering | Good | Excellent | Poor | Poor | Good | Comparative example |
| 65 | 1050 | no tempering | Poor | Poor | Good | Good | Good | Comparative example |
| 66 | 1000 | no tempering | Poor | Poor | Good | Good | Good | Comparative example |
| 67 | 1030 | 300 | Poor | Poor | Good | Good | Good | Comparative example |
| 68 | 980 | no tempering | Good | Good | Poor | Poor | Poor | Comparative example |
| 69 | 1000 | 400 | Poor | Poor | Good | Poor | Poor | Comparative example |
| 70 | 1050 | no tempering | Poor | Poor | Poor | Poor | Poor | Comparative example |
| 71 | 1030 | no tempering | Good | Good | Good | Good | Poor | Comparative example |
| 72 | 1050 | no tempering | Good | Good | Poor | Poor | Good | Comparative example |
| 73 | 1050 | no tempering | Good | Good | Excellent | Excellent | Excellent | Example |
| 74 | 1030 | 300 | Excellent | Good | Excellent | Excellent | Excellent | Example |
| 75 | 1000 | no tempering | Excellent | Good | Excellent | Excellent | Excellent | Example |
| 76 | 1030 | 200 | Excellent | Good | Excellent | Excellent | Excellent | Example |
| 77 | 1050 | 300 | Excellent | Good | Excellent | Excellent | Excellent | Example |

TABLE 2-continued

| Steel No. | Producing conditions: Quenching temperature (° C.) | Producing conditions: Tempering temperature (° C.) | Evaluation results: Tensile strength | Evaluation results: Poof stress | Evaluation results: Elongation | Evaluation results: Ultimate deformability | Evaluation results: Corrosion resistance | Remarks |
|---|---|---|---|---|---|---|---|---|
| 78 | 1030 | no tempering | Good | Good | Excellent | Excellent | Excellent | Example |
| 79 | 1000 | 200 | Excellent | Good | Good | Excellent | Excellent | Example |
| 80 | 1050 | 200 | Excellent | Good | Good | Excellent | Excellent | Example |
| 81 | 1050 | 300 | Excellent | Good | Good | Excellent | Excellent | Example |
| 82 | 1030 | no tempering | Good | Good | Excellent | Excellent | Excellent | Example |
| 83 | 1000 | 200 | Excellent | Good | Excellent | Good | Excellent | Example |

As illustrated in Table 1, examples No. 1 to 58 and No. 73 to 83 were excellent both in strength and elongation, and the proof stress, ultimate deformability and corrosion resistance thereof were also sufficient. Particularly, examples No. 24 to 40 and No. 48 containing 1.0% or more of Cu are excellent with high proof stress after quenching. Examples No. 34 and No. 43 to 57 containing 0.01% or more of V are particularly excellent in corrosion resistance. Furthermore, examples No. 73 to 82 are particularly excellent in ultimate deformability, where the examples No. 73 to 82 contain Nb and V, Nb: 0.002% or more and less than 0.050%, V: 0.01% or more and less than 0.10%, and satisfy the relationship of Nb %+V %≤C %+N %.

On the other hand, comparative examples No. 59 (corresponding to SUS403) and No. 60, whose C is high and outside an appropriate range, passed in strength and proof stress, yet failed in elongation, ultimate deformability and corrosion resistance. Comparative example No. 61, where N %<C % (N %/C %<1), passed in elongation because of tempering, yet failed in strength, proof stress and ultimate deformability. Regarding comparative example No. 62 whose Si is high and outside an appropriate range, the martensite content after quenching was low, and the strength, proof stress and ultimate deformability were unpassed. Comparative example No. 63, whose Mn is high and outside an appropriate range, was too much in strength and proof stress, and failed in elongation and ultimate deformability. Comparative example No. 64 failed in elongation and ultimate deformability because the Mn content is high and outside an appropriate range in the case that the Cu content is high. Comparative example No. 65 failed in strength and proof stress because the N content is low and outside an appropriate range. Comparative example No. 66 had a higher Cr content than an appropriate range, and accordingly the martensite content after quenching was low, and the strength and proof stress were unpassed. Comparative example No. 67 failed in strength after tempering and proof stress because that N %<C %. Comparative example No. 68, whose C content is higher than an appropriate range, failed in elongation, ultimate deformability and corrosion resistance. Comparative example No. 69, whose C content is also high, passed in elongation after tempering, yet failed in strength, proof stress, ultimate deformability and corrosion resistance. Comparative example No. 70 had a high content of V, and accordingly the martensite content after quenching was low, and the strength, proof stress, elongation, ultimate deformability and corrosion resistance were unpassed. Comparative example No. 71 failed in corrosion resistance because of a low content of Cr. Comparative example No. 72 failed in elongation and ultimate deformability because of a high content of Ni.

INDUSTRIAL APPLICABILITY

The martensitic stainless steel of the disclosure is excellent in both strength (tensile strength and proof stress) and workability (elongation and ultimate deformability), and therefore is suitable for gasket members. It is also suitable for members that require spring resistance.

The invention claimed is:

1. A cold rolled martensitic stainless steel sheet comprising a chemical composition consisting of, in mass %:

C: 0.027% or more and less than 0.10%,
Si: 0.01% or more and 2.0% or less,
Mn: 0.01% or more and 3.0% or less,
P: 0.050% or less, S: 0.050% or less,
Cr: 10.0% or more and 16.0% or less,
Ni: 0.01% or more and 0.80% or less,
Al: 0.001% or more and 0.50% or less,
N: more than 0.050% and 0.163% or less,
B: 0.0002% or more and 0.0030% or less,
Nb: 0.002% or more and less than 0.05%,
V: 0.01% or more and 0.10% or less, and
optionally one or more selected from, in mass %:
Mo: 0.01% or more and 0.50% or less,
Co: 0.01% or more and 0.50% or less,
Ti: 0.01% or more and 0.50% or less,
Zr: 0.01% or more and 0.50% or less,
Ca: 0.0002% or more and 0.0100% or less, and
Mg: 0.0002% or more and 0.0100% or less, and satisfying the following relational expressions (1) and (2), and the balance containing Fe and incidental impurities, $$5\times C\ \% \geq N\ \% \geq C\ \% \quad (1)$$

$$Nb\ \% + V\ \% \leq C\ \% + N\ \% \quad (2)$$

wherein C %, N %, Nb %, and V % indicate respectively the contents of C, N, Nb, and V (mass %) in the steel, and wherein the cold rolled martensitic stainless steel sheet has a tensile strength of 1200 MPa or more, an elongation of 7.5% or more, and an ultimate deformability of 0.5 or more, and a structure of the cold rolled martensitic stainless steel sheet is martensite single phase.

2. The cold rolled martensitic stainless steel sheet of claim 1, wherein the cold rolled martensitic stainless steel sheet has a tensile strength of 1200 MPa or more, an elongation of 7.5% or more, and an ultimate deformability of 0.7 or more.

* * * * *